US007375067B2

(12) United States Patent
Hayashi et al.

(10) Patent No.: US 7,375,067 B2
(45) Date of Patent: May 20, 2008

(54) LIQUID DETERGENT COMPOSITION COMPRISING AN ANIONIC SURFACTANT, AMINE OXIDE, AND ALKYL GLYCERYL ETHER

(75) Inventors: Hiromitsu Hayashi, Wakayama (JP); Nobuhiro Nishizawa, Wakayama (JP); Yoshihiro Yomogida, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/534,361

(22) PCT Filed: Jan. 28, 2004

(86) PCT No.: PCT/JP2004/000770

§ 371 (c)(1),
(2), (4) Date: Dec. 13, 2005

(87) PCT Pub. No.: WO2004/067690

PCT Pub. Date: Aug. 12, 2004

(65) Prior Publication Data

US 2006/0105933 A1 May 18, 2006

(30) Foreign Application Priority Data

Jan. 28, 2003 (JP) ..... 2003-018803
May 30, 2003 (JP) ..... 2003-154974
Jun. 12, 2003 (JP) ..... 2003-167292

(51) Int. Cl.
*C11D 1/75* (2006.01)
*C11D 1/83* (2006.01)
*C11D 3/43* (2006.01)
*C11D 7/10* (2006.01)

(52) U.S. Cl. ..... 510/237; 510/123; 510/125; 510/127; 510/235; 510/271; 510/290; 510/333; 510/351; 510/426; 510/427; 510/432; 510/506

(58) Field of Classification Search ..... 510/123, 510/125, 127, 235, 237, 271, 290, 333, 351, 510/426, 427, 432, 506
See application file for complete search history.

(56) References Cited

U.S. PATENT DOCUMENTS 5,409,628 A * 4/1995 Heinz et al. ..... 510/122

FOREIGN PATENT DOCUMENTS

| | | | |
|---|---|---|---|
| EP | 1092761 | * | 4/2001 |
| EP | 1092761 A2 | | 4/2001 |
| JP | 5-148494 A | | 6/1993 |
| JP | 6-116587 A | | 4/1994 |
| JP | 7-188697 A | | 7/1995 |
| JP | 8-501817 A | | 2/1996 |
| JP | 8-502310 A | | 3/1996 |
| JP | 8-502540 A | | 3/1996 |
| JP | 8-508033 A | | 8/1996 |
| JP | 8-508059 A | | 8/1996 |
| JP | 10-204483 A | | 8/1998 |
| JP | 11-310792 A | | 11/1999 |
| JP | 2000-26889 A | | 1/2000 |
| JP | 2001-19993 A | | 1/2001 |
| JP | 2001019993 | * | 1/2001 |
| JP | 2001-49291 A | | 2/2001 |
| JP | 2001-271094 A | | 10/2001 |
| JP | 2002-226887 A | | 8/2002 |
| JP | 2003-13092 A | | 1/2003 |
| WO | WO-94/07977 A2 | | 4/1994 |
| WO | WO-94/09102 A1 | | 4/1994 |
| WO | WO-94/10279 A1 | | 5/1994 |
| WO | WO-94/21655 A1 | | 9/1994 |
| WO | WO-94/21769 A1 | | 9/1994 |

* cited by examiner

*Primary Examiner*—Charles Boyer
(74) *Attorney, Agent, or Firm*—Birch, Stewart, Kolasch & Birch, LLP

(57) ABSTRACT

The present invention relates to a liquid detergent composition including (a) an anionic surfactant containing a hydrocarbon group having 10 to 18 carbon atoms, (b) an amine oxide surfactant containing a hydrocarbon group having 10 to 18 carbon atoms, (c) 2-ethylhexyl monoglyceryl ether, a compound represented by the formula (5) or a compound represented by the formula (6) and (d) water in each specified ratio:

$$R^{5a}—(OR^{5b})_{a5}—OH \quad (5)$$

$$R^{6a}—(OR^{6b})_{a6}G_{b6}, \quad (6)$$

2 Claims, No Drawings

LIQUID DETERGENT COMPOSITION COMPRISING AN ANIONIC SURFACTANT, AMINE OXIDE, AND ALKYL GLYCERYL ETHER

FIELD OF THE INVENTION

The present invention relates to a liquid detergent composition and a washing method using the liquid detergent composition.

PRIOR ARTS

Many dishwashing detergents use an anionic surfactant as the surfactant which is a major component from the viewpoint of detergency.

Foaming ability and foam retaining ability are demanded of these dishwashing detergents during washing. It is preferable to use in combination an amine oxide surfactant as a foaming agent to solve these problems. Amine oxide improves not only foaming characteristics but also detergency by combining an anionic surfactant. This is considered to be because amine oxide has a cationic nature in a neutral-acidic region and therefore forms an ionic complex with the anion of the anionic surfactant whereby oil emulsifying ability is improved and eventually detergency is improved.

Also, techniques using an alkyl glyceryl ether for dishwashing detergents are known. Techniques concerning dishwashing detergents comprising an anionic surfactant, an amine oxide surfactant and an alkyl glyceryl ether are disclosed in JP-A 2001-19993. There are descriptions concerning a combination with an amine oxide surfactant in the detailed description of the present invention of JP-A 2001-49291; this techniques in the publication is also to improve washing effects. JP-A 11-310792 discloses techniques concerning a detergent using a branched-chain alkyl glyceryl ether and suggests that this detergent may be used in kitchen applications.

Polyoxyalkylene type nonionic surfactants are surfactants used commonly as liquid detergents like the aforementioned anionic surfactants and amine oxide surfactants and liquid detergents using a combination of these surfactants are known.

JP-A 2002-226887 discloses a kitchen detergent including a specific anionic surfactant, an amine oxide surfactant and a nonionic surfactant and as to the nonionic surfactant, those in which the alkyl group is a branched-chain alkyl group such as isooctyl, isononyl or isodecyl are exemplified. JP-A 7-188697 discloses an aqueous disinfectant liquid composition which contains a nonionic surfactant with an alkyl group having a specific chain length and is desirable for washing dishes. In JP-A 6-116587, a dishwashing detergent containing a nonionic surfactant obtained by adding an alkylene oxide to a branched-chain alcohol having 2 to 30 carbon atoms is exemplified. There are descriptions in JP-A 8-502540 that a nonionic surfactant obtained by adding 4 to 9 mols of ethylene oxide to a middle-chain alcohol such as octanol and decanol or an alkyl glycoside having 6 to 22 carbon atoms has an effect on the stability of an aqueous anionic surfactant solution and may be applied to a dishwashing detergent.

A detergent containing a compound corresponding to the component (a) which is the structural requirement of the present invention is disclosed in JP-A 2003-13092. It is also disclosed that a detergent effective for washing hard surfaces such as that of a plastic is obtained.

Alkylglycoside surfactants are surfactants which are commonly used in liquid detergents similarly to the aforementioned anionic surfactants and amine oxide surfactants and liquid detergents having combinations of these surfactants are known.

In JP-A 8-502310, there is the description that alkylglycosides having 4 to 22 carbon atoms have foaming ability and detergency. In JP-A 8-501817, alkylglycosides having 8 to 12 carbon atoms are used as a rinsing agent for washing dishes. In JP-A 5-148494, a detergent is disclosed which includes an alkylglycoside having 8 to 18 carbon atoms, an anionic surfactant and an amine oxide surfactant, is suitable for washing dishes and does not cause hand chapping. In JP-A 2000-26889, a detergent composition is disclosed which includes a combination of an alkylglycoside having 8 to 18 carbon atoms and an amine oxide surfactant and is suitable for washing dishes. In U.S. Pat. No. 4,488,981, there is the description that an alkylglycoside containing an alkyl group having 2 to 6 carbon atoms has an effect on a decrease in the viscosity of a detergent composition and on an improvement in the stability of the composition.

SUMMARY OF THE INVENTION

The present invention relates to a liquid detergent composition including (a) 5 to 50 mass % of an anionic surfactant containing a hydrocarbon group having 10 to 18 carbon atoms, (b) 1 to 15 mass % of an amine oxide surfactant containing a hydrocarbon group having 10 to 18 carbon atoms, 0.1 to 10 mass % of (c) selected from the following (c-1), (c-2) and (c-3) and (d) water:

(c-1) 2-ethylhexyl monoglyceryl ether;

(c-2) a compound represented by the following formula (5):

$$R^{5a}\text{—}(OR^{5b})_{a5}\text{—}OH \quad (5)$$

wherein $R^{5a}$ represents a 2-ethylhexyl group, $R^{5b}$ represents an alkylene group having 2 to 4 carbon atoms and a5 denotes a number of 2 to 5 on the average; and (c-3) a compound represented by the following formula (6)

$$R^{6a}\text{—}(OR^{6b})_{a6}G_{b6} \quad (6)$$

wherein $R^{6a}$ represents a group selected from 2-ethylhexyl, isononyl and isodecyl, $R^{6b}$ represents an alkylene group having 2 to 4 carbon atoms, G represents a residue derived from reducing sugar, a6 denotes a number of 0 to 6 on the average; and b6 denotes a number of 1 to 5 on the average.

Further, the present invention relates to a method of washing a hard surface by applying a flexible material impregnated with the above liquid detergent composition without diluting the composition to the hard surface.

DETAILED DESCRIPTION OF THE INVENTION

The inventors of the present invention have found that the contact between a highly concentrated surfactant and a hard surface makes it easy to remove oil stains stuck to the hard surface, whereas en excess surfactant causes a slimy feel problem. The slimy feel is felt by the fingers, palm and the like which are in contact with the surface of a subject to be washed during washing or rinsing and is such a feeling that the detergent exists on a smooth surface to be washed as if it were an oil film. It is hard to remove this feeling not only during washing but also during rinsing. Although a basic slimy feel can be solved by carrying out sufficient rinsing (making rinsing time longer than usual rinsing time), the slimy feel which is left insistently during rinsing is not desirable because users may have an uncomfortable feel. Waste of water is caused by increased rinsing time.

The inventors of the present invention have found that the slimy feel is made more significant by using an amine oxide surfactant. This reason is estimated that the amine oxide surfactant itself tends to have slimy qualities compared with other surfactants and, in addition, the formation of the complex has the effect on increasing the slimy feel. When the amount of the amine oxide surfactant is decreased, foaming ability is impaired though a slimy feel during washing and rinsing is improved. From the above reason, the inventors of the present invention have made earnest studies concerning a liquid detergent satisfying both of the foaming ability and the improvement in greasy feel during washing and rinsing, leading to the completion of the present invention.

The present invention relates to a liquid detergent which satisfies both of the foaming ability and the improvement in slimy feel during washing and rinsing.

<Component (a)>

The component (a) of the present invention is an anionic surfactant containing a hydrocarbon group having 10 to 18 carbon atoms. Preferable and specific examples of the component (a) may include an alkylbenzenesulfonic acid containing an alkyl group having 10 to 15 carbon atoms or its salt, monoalkyl sulfate having 10 to 16 carbon atoms, polyoxyalkylene alkyl ether sulfate containing an alkyl group having 10 to 16 carbon atoms and added with 1.0 to 4.0 mols (on the average) of an oxyalkylene group having 2 or 3 carbon atoms, α-olefin sulfonate having 8 to 16 carbon atoms and α-sulfofatty acid (8 to 16 carbon atoms) lower alkyl (1 to 3 carbon atoms) ester salt. Examples of the salt include a sodium salt, potassium salt, magnesium salt and alkanolamine salt. Particularly, a sodium salt, potassium salt and magnesium salt are preferable from the viewpoint of viscosity.

In the present invention, particularly, a polyoxyalkylene alkyl ether sulfate containing an alkyl group having 10 to 14 carbon atoms and 1.0 to 3.0 mols (on the average), particularly preferably 1.5 to 3.0 mols, of an added oxyalkylene group having 2 to 3 carbon atoms, preferably an oxyethylene group, preferably a sodium salt, potassium salt, calcium salt or magnesium salt, is preferably used from the viewpoint of washing effects and also because the preserving stability of a composition containing an anionic surfactant in a high concentration at low temperatures or high temperatures can be improved.

In the case of using a polyoxyalkylene alkyl ether sulfate, a polyoxyalkylene alkyl ether sulfate having a branched-chain primary alkyl group which is manufactured by using, as raw material, an alcohol obtained by hydroformylation of a straight-chain1-alkene is preferable. Here, the hydroformylation is a method of obtaining an alcohol by adding carbon monoxide to a straight-chain 1-alkene with a carbonyl complex of iron, cobalt, nickel or the like as a catalyst. An alcohol containing a straight-chain alkyl group and a methyl-branched alkyl group is obtained by this method. The polyoxyalkylene alkyl ether sulfate may be obtained by further adding an alkylene oxide, preferably propylene oxide (hereinafter referred to as PO) or ethylene oxide (hereinafter referred to as EO) and more preferably EO to the obtained alcohol and by further carrying out sulfonation using sulfur trioxide or chlorosulfonic acid, followed by neutralizing the sulfonated product by using an alkali agent. The average added mole number is preferably 1.0 to 3.0, more preferably 1.5 to 3.0 and particularly preferably 1.5 to 2.5 from the viewpoint of washing effects. The alkali agent used for neutralization is preferably sodium hydroxide, potassium hydroxide, magnesium hydroxide, sodium carbonate, potassium carbonate or magnesium carbonate and more preferably sodium hydroxide, potassium hydroxide and magnesium hydroxide. The polyoxyalkylene alkyl ether sulfate obtained in this manner contains a branched-chain alkyl group. The ratio by mass of the polyoxyalkylene branched-chain alkyl ether sulfate to all polyoxyalkylene alkyl ether sulfate is preferably 5 to 80 mass % and more preferably 10 to 70 mass % to achieve excellent washing effects.

In the case of blending, particularly, a polyoxyalkylene alkyl ether sulfate in an amount exceeding 10 mass %, particularly, in an amount of 15 to 40 mass % in the composition, the alkyl group of the polyoxyalkylene alkyl ether sulfate preferably satisfies the aforementioned requirement as to the branch ratio. The polyoxyalkylene alkyl ether sulfate itself exhibits qualities more reduced in slimy feel than other surfactants. However, there is a concern as to an increase in slimy feel due to the polyoxyalkylene alkylene alkyl ether sulfate itself which tends to be left on the surface to be washed due to thickening viscosity and gelation caused by an increase in concentration in addition to a rise in slimy feel due to the amine oxide surfactant used together. This problem is decreased by choosing the above compound having a branched chain.

<Component (b)>

The component (b) in the present invention is an amine oxide surfactant containing a hydrocarbon group having 10 to 18 carbon atoms. To state in more detail, compounds represented by the following formula (1) are preferable as the component (b).

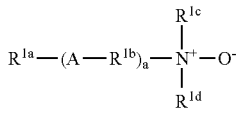

$$R^{1a}-(A-R^{1b})_a-\overset{\overset{R^{1c}}{|}}{\underset{\underset{R^{1d}}{|}}{N^+}}-O^- \quad (1)$$

wherein $R^{1a}$ represents an alkyl group or an alkenyl group having 8 to 18 carbon atoms, $R^{1b}$ represents an alkylene group having 1 to 6 carbon atoms, A represents a group selected from —COO—, —CONH—, —OCO— and —NHCO—, a denotes a number of 0 or 1, $R^{1c}$ and $R^{1d}$ respectively represent an alkyl group or a hydroxyalkyl group having 1 to 3 carbon atoms.

In the formula (1), $R^{1a}$ is an alkyl group or an alkenyl group having preferably 10 to 16 carbon atoms and more preferably 10 to 14 carbon atoms, and particularly preferably a lauryl group (or a lauric acid residue) and/or a myristyl group (or a myristic acid residue). A is preferably —COO— or —CONH, even more preferably —CONH—. The number of carbons of $R^{1b}$ is preferably 2 or 3, and $R^{1c}$ and $R^{1d}$ are each preferably a methyl group.

In the present invention, $R^{1a}$ may be either a single alkyl (or alkenyl) chain length or a mixture of alkyl groups (alkenyl groups) having different alkyl (or alkenyl) chain lengths. In the latter case, those having mixed alkyl (or alkenyl) chain lengths derived from vegetable oils selected from coconut oil and palm kernel oil are preferable. Specifically, the molar ratio of a lauryl group (or a lauric acid residue)/a myristyl group (or a myristic acid residue) is 95/5 to 20/80 and preferably 90/10 to 30/70 from the viewpoint of washing effect and foaming ability.

<Component (c)>

The component (c-1) of the present invention is 2-ethylhexyl monoglyceryl ether. The glyceryl ether is usually obtained in a method of producing by reacting 2-ethylhexanol with an epoxy compound such as epihalohydrin or glycidol by using an acid catalyst such as $BF_3$ or an aluminum catalyst. The component (c-1) is a mixture containing plural products as described in JP-A 2001-49291. Specific examples of 2-ethylhexyl monoglyceryl ether include a compound (3-(2-ethylhexyloxy)-1,2-propanediol, hereinafter referred to as (c1)) in which 2-ethylhexanol is added to the first position of an epoxy compound and a compound (2-(2-ethylhexyloxy)-1,3-propanediol, hereinafter referred to as (c2)) in which 2-ethylhexanol is added to the second position of an epoxy compound. Also, examples of byproducts include multi-addition compounds (hereinafter referred to as (c3)) in which an epoxy compound is further added to the above (c1) or (c2).

In the present invention, it is preferable to use 2-ethylhexyl monoglyceryl ether in which the content of the component (c3) in the component (c-1) is 30 mass % or less, preferably 10 mass % or less and particularly preferably 1 mass % or less.

<Component (c-2)>

The component (c-2) of the present invention is the compound represented by the formula (5). In the formula, $R^{3a}$ represents a 2-ethylhexyl group, $R^{1b}$ represents an alkylene group having 2 to 4 carbon atoms and is preferably an ethylene group or a propylene group and particularly preferably an ethylene group and a denotes a number of 2 to 5 on the average.

The compound represented by the formula (5) is a mixture of compounds represented by the formula (5) in which a is about 0 to 10 (2 to 5 on the average) and obtained by reacting 2-ethylhexanol with an alkylene oxide, preferably propylene oxide and/or ethylene oxide and particularly ethylene oxide such that the molar ratio of alcohol/alkylene oxide is 1/2 to 1/5, and may include unreacted 2-ethylhexanol.

Although the component (c-2) may contain unreacted alcohol (2-ethylhexanol) produced at the time of synthesis together with the compound represented by the formula (5), the content of the unreacted alcohol is preferably smaller to obtain the effect of the present invention.

When the component (c-2) is a mixture of the compound represented by the formula (5) and the unreacted alcohol, it is preferably one containing unreacted alcohol wherein the content of the unreacted alcohol (2-ethylhexanol) in the component (c-2) is preferably 5 mass % or less, more preferably 3 mass % or less and still more preferably 1 mass % or less and represented by the formula (5) in which a is 2 to 5 on the average.

Also, as the component (c-2), one from which unreacted alcohol (a compound when a=0) and/or compounds when a>5 are removed by further carrying out operations such as distillation after the compound represented by the formula (5) is synthesized by the above method may be used.

The average of a can be easily found from an integral value of the α-position proton of a 2-ethylhexyl group and the proton of an oxyethylene group by using $H^1$-NMR.

<Component (c-3)>

The component (c-3) in the present invention is the compound represented by the formula (6). In the formula, $R^{1a}$ is a group selected from a 2-ethylhexyl group, an isononyl group and an isodecyl group and is particularly preferably a 2-ethylhexyl group. $R^{1b}$ is an alkylene group having 2 to 4 carbon atoms, preferably an ethylene group or a propylene group and particularly an ethylene group. G represents a residue derived from reducing sugar, a denotes 0 to 6, preferably 0 to 3 and particularly preferably 0 on the average and b denotes 1 to 5, preferably 1 to 3 and particularly preferably 1 to 2 on the average.

G is a residue derived from a reducing sugar. The reducing sugar as the raw material may be either aldose or ketose and may be triose, tetrose, pentose or hexose having 3 to 6 carbon atoms. Examples of the aldose may include apiose, arabinose, galactose, glucose, lyxose, mannose, gulose, aldose, idose, talose and xylose. Examples of the ketose may include fructose.

Among these reducing sugars, aldopentose or aldohexose having 5 or 6 carbon atoms are preferable and glucose is more preferable. As the reducing sugar G, the aforementioned monosaccharides are preferable and oligosaccharides which are condensates of 2 to 5 and preferably 2 or 3 of these monosaccharides may be used without any problem. Further, a mixture of a monosaccharide and an oligosaccharide may be used. In this case, the average degree of condensation is preferably 1 to 5, more preferably 1 to 3, even more preferably 1 to 2, even more preferably 1 to 1.5.

Compounds represented by the formula (6) in which a is 0 may be easily synthesized by an acetal reaction or ketal reaction between 2-ethylhexanol, isononanol or isodecanol and the above reducing sugar by using an acid catalyst. Also, compounds represented by the formula (6) in which a is not 0 may be easily synthesized by an acetal reaction or ketal reaction between $R^{1a}$—$(OR^{1b})_a$—OH obtained by adding an alkylene oxide to 2-ethylhexanol, isononanol or isodecanol and the above reducing sugar by using an acid catalyst. When applying an acetal reaction, either a hemiacetal structure or a usual acetal structure is acceptable.

It is to be noted that 2-ethylhexanol may be obtained by aldol condensation between 2-ethylhexanol and n-butylaldehyde, followed by hydrogenating. Isononanol is obtained by hydroformylation of diisobutylene by an oxo method, followed by hydrogenating. A typical structure of isononanol is 3,5,5-trimethylhexanol. Isodecanol is obtained by hydroformylation of nonene by an oxo method, followed by hydrogenating and is a mixture of many isomers having a methyl branch at each position of alkyl chains. A typical structure of isodecanol is 8-methyl-1-nonanol.

<Other Components>

In the present invention, it is preferable to compound magnesium (hereinafter referred to as component (e)) to improve the emulsifying ability of an anionic surfactant thereby enhancing washing effects. Magnesium, which exists in the state of a salt or a free ion in the system, may be compounded as the counter ion of the component (a) or as a water-soluble magnesium compound. Among the magnesium compounds described in Chemical Handbook Fundamental II (Revised edition No. 3) p 166, Table 8. 42 and p 190, Table 8.47, those having a solubility of 1 g/100 g or more and preferably 10 g/100 g or more in water at 20° C. are preferable as the water-soluble magnesium compound. Among these compounds, magnesium sulfates, magnesium chloride, magnesium carbonate, magnesium nitrate and magnesium acetate are more preferable in the present invention.

In the present invention, it is preferable to contain a surfactant (hereinafter referred to as a component (f)) other than the components (a) and (b) to strengthen the detergency of the composition. As the surfactant, particularly a compound selected from amphoteric surfactants and nonionic surfactants other than the component (b) are preferable.

As the amphoteric surfactant, compounds (hereinafter referred to as a component (f-1)) represented by the following formula (2) are preferable.

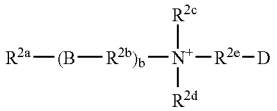

(2)

wherein, $R^{2a}$ represents an alkyl group or an alkenyl group having 9 to 23 carbon atoms, $R^{2b}$ represents an alkylene group having 1 to 6 carbon atoms. B represents a group selected from —COO—, —CONH—, —OCO—, —NHCO— or —O— and b denotes a number 0 to 1. $R^{2c}$ and $R^{2d}$ respectively represent an alkyl group or a hydroxyalkyl group having 1 to 3 carbon atoms and $R^{2e}$ represents an alkylene group having 1 to 5 carbon atoms which may be substituted with a hydroxy group. D represents a group selected from $—SO_3^-$, $—OSO_3^-$ and $—COO^-$.

In the formula (2), $R^{2a}$ is an alkyl group having preferably 9 to 15 and particularly 9 to 13 carbon atoms and $R^{2b}$ represents an alkylene group having preferably 2 or 3 carbon atoms. B is preferably —CONH— and b is preferably 0 or 1. $R^{2c}$ and $R^{2d}$ are respectively preferably a methyl group or a hydroxyethyl group. D is preferably $—SO_3^-$ or $—COO^-$ and $R^{2e}$ is preferably $—CH_2CH(OH)CH_2—$ when D is $—SO_3^-$ and preferably a methylene group when D is $—COO^-$.

As the nonionic surfactant (hereinafter referred to as a component (f-2)), compounds selected from compounds represented by the following formula (3) and compounds represented by the following formula (4) are preferable.

$$R^{3a}\text{-E-}[(R^{3b}O)_c—H]_d \quad (3)$$

wherein, $R^{3a}$ represents an alkyl group or an alkenyl group having 7 to 18 carbon atoms, $R^{3b}$ represents an alkylene group having 2 or 3 carbon atoms. c denotes a number of 2 to 100. E represents —O—, —CON— or —N—. d is 1 when E is —O— and 2 when E is —CON— or —N—.

$$R^{4a}—(OR^{4b})_eG_f \quad (4)$$

wherein, $R^{4a}$ represents a straight-chain alkyl group having 8 to 16, preferably 10 to 16 and particularly preferably 10 to 14 carbon atoms, $R^{4b}$ represents an alkylene group having 2 to 4 carbon atoms, is preferably an ethylene group or a propylene group and is particularly ethylene group. G represents a residue derived from reducing sugar, e denotes a number of 0 to 6, preferably 0 to 3 and particularly preferably 0 on the average and f denotes a number of 1 to 10, preferably 1 to 5 and particularly preferably 1 to 2 on the average.

Specific examples of the compound represented by the formula (3) may include the following compounds.

$$R^{3a}—O—(C_2H_4O)_g—H \quad (3\text{-a})$$

wherein, $R^{3a}$ has the above meaning and g is a number of 2 to 100.

$$R^{3a}—O—(C_2H_4O)_h(C_3H_6O)_i—H \quad (3\text{-b})$$

wherein, $R^{3a}$ has the above meaning and h and i independently denote a number of 2 to 70, and the ethylene oxide and propylene oxide may be respectively either a random or block adduct.

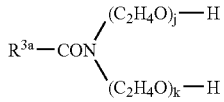

(3-c)

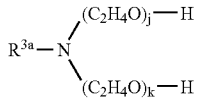

(3-d)

wherein, $R^{3a}$ has the above meaning.

The sum of j and k is a number of 3 to 70.

The sum of j and k is a number of 3 to 150.

In the formula (4), G is a residue derived from reducing sugar. The reducing sugar as the raw material may be either aldose or ketose and may be triose, tetrose, pentose or hexose having 3 to 6 carbon atoms. Examples of the aldose may include apiose, arabinose, galactose, glucose, lyxose, mannose, gulose, aldose, idose, talose and xylose. Examples of the ketose may include fructose. Among these reducing sugars, aldopentose or aldohexose having 5 or 6 carbon atoms are preferable and glucose is more preferable in the present invention.

The compound represented by the formula (4) can be easily synthesized by an acetal reaction or ketal reaction between the above reducing sugar and $R^{4a}—(OR^{4b})_e—OH$ by using an acid catalyst. When applying an acetal reaction, either a hemiacetal structure or a usual acetal structure may be acceptable.

As the component (f) in the present invention, one or more types selected from particularly the compounds represented by the formula (2) and the compounds represented by the formula (4) are preferable because foaming characteristics can be improved and washing effects can be enhanced.

The liquid detergent composition of the present invention preferably contains a hydrotropic agent (hereinafter referred to as a component (g)) to improve preserving stability. As the hydrotropic agent, toluenesulfonic acid, xylenesulfonic acid, cumenesulfonic acid and sodium, potassium or magnesium salts of these acids are preferable and p-toluenesulfonic acid is particularly preferable.

In the present invention, a solvent (hereinafter referred to as a component (h)) other than the component (c) may be contained to improve preserving stability and as a viscosity regulator. As specific examples of the solvent, water-soluble organic solvents selected from ethanol, isopropyl alcohol, ethylene glycol, propylene glycol, diethylene glycol, dipropylene glycol, glycerine, isopropylene glycol, propylene glycol monomethyl ether and propylene glycol monoethyl ether are preferable.

It is desirable to formulate a polymer for preventing gelation, for example, a gelation preventive polymer (hereinafter referred to as component (i)) described in the publication of Japanese Patent Application National Publication (Laid-Open) No. 11-513067 and especially a polyalkylene glycol from the viewpoint of viscosity regulation and preserving stability. Specific examples of the polyalkylene glycol for preventing gelation include a polypropylene glycol and polyethylene glycol having a weight average molecular weight of 200 to 3000 which is found by gel permeation chromatography using a polyethylene glycol as the standard.

<Liquid Detergent Composition Containing (c-1)>

The liquid detergent composition of the present invention contains the component (a) in an amount of 5 to 50 mass %, preferably 10 to 45 mass % and more preferably 10 to 40 mass % from the viewpoint of detergent effect. The liquid detergent composition contains the component (b) in an amount of 1 to 15 mass %, preferably 1 to 10 mass % and more preferably 2 to 10 mass %. Also, the ratio by mass of component (a)/component (b) is preferably 20/1 to 1/1, more preferably 10/1 to 1/1 and particularly 5/1 to 1/1 from the viewpoint of detergency and foaming ability. The liquid detergent composition further contains the component (c-1) in an amount of 0.1 to 10 mass %, preferably 0.3 to 7 mass % and more preferably 0.5 to 5 mass %. Particularly, the ratio by mass of (Component (a)+Component (b))/Component (c-1) is preferably 200 to 1, more preferably 100 to 1.5, even more preferably 20 to 1. When the amount of the component (c-1) is less than the above range, a slimy feel when washing dishes cannot be restricted whereas when the amount exceeds the above range, foaming ability tends to be suppressed and therefore, an amount out of the above range is undesirable.

Although the component (e) of the present invention is optional, it is preferable to contain the component (e) because it can provide a high detergent effect by interaction with the component (a) and also because it can suppress a slimy feel in combination with the component (c-1). In the present invention, it is preferable to contain the component (e) as magnesium in an amount of preferably 0.01 to 2 mass %, more preferably 0.05 to 1 mass % and particularly 0.1 to 1 mass %. The mol ratio of component (a)/component (e) (as magnesium) is preferably 300/1 to 1/1, more preferably 100/1 to 1/1 and particularly preferably 50/1 to 2/1.

<Liquid Detergent Composition Containing (c-2) or (c-3)>

The content of each component in the composition of the present invention is as follows.

The component (c-2) or (c-3) is contained in an amount. of 0.1 to 10 mass %, preferably 0.3 to 7 mass % and more preferably 0.5 to 5 mass %.

The component (a) is contained in an amount of 5 to 50 mass %, preferably 10 to 45 mass % and more preferably 10 to 40 mass % from the viewpoint of detergent effect.

The component (b) is contained in an amount of 1 to 15 mass %, preferably 1 to 10 mass % and more preferably 2 to 10 mass %.

The components (a) and (b) are contained such that the ratio by mass of component (a)/component (b) is in a range preferably from 20/1 to 1/1, more preferably from 10/1 to 1/1 and particularly 5/1 to 1/1 from the viewpoint of detergency and foaming ability.

As to the component (c-2) or (c-3) and the components (a) and (b), the ratio by mass of (component (a)+component (b))/(component (c-2) or (c-3)) is in a range preferably from 200/1 to 1/1, more preferably 100/1 to 1.5/1, even more preferably 20/1 to 2/1. In the case where the above ratio by mass of (component (a)+component (b))/(component (c-2) or (c-3)) is out of the above range, a slimy feel when washing dishes cannot be restricted and foaming ability tends to be suppressed and therefore, an amount out of the above range is undesirable.

In the present invention, the component (f) is preferably contained to enhance detergent effect and to improve preserving stability. Particularly, the compound of the formula (2) and the compound of the formula (4) can improve foaming ability. However, an excess of the amount of the component (f) tends to promote a slimy feel when washing dishes and to decrease the effect of the component (c). Therefore, the ratio of the component (f) in the composition is preferably 0.1 to 20 mass %, more preferably 0.5 to 15 mass % and particularly preferably 1.0 to 15 mass %.

In order to obtain a remarkable effect of the present invention, the ratio by mass of (Component (a)+Component (b)+Component (c))/(Component (a)+Component (b)+Component (c)+Component (f)) is preferably 0.5 or more, more preferably 0.6 or more and still more preferably 0.7 or more. It is desirable to satisfy the above requirement for the mass ratio also from the viewpoint of improving detergency.

The component (g) in the present invention is preferably contained from the viewpoint of preserving stability and is contained in an amount of preferably 0.1 to 10 mass %, more preferably 0.5 to 10 mass % and particularly preferably 1 to 6 mass %.

The components (h) and (i) in the present invention are preferably contained from the viewpoint of improving preserving stability and are also effective as a viscosity regulator. The component (h) is contained in an amount of preferably 1 to 20 mass %, more preferably 3 to 20 mass % and particularly preferably 5 to 15 mass % in the composition and the component (i) is contained in an amount of preferably 0.05 to 10 mass %, more preferably 0.05 to 5 mass % and particularly preferably 0.1 to 3 mass %.

The composition of the present invention is put in the state of a solution prepared by dissolving or dispersing the above components in water which is the component (d). The content of water is preferably 20 to 60 mass %, more preferably 30 to 60 mass %, still more preferably 40 to 60 mass % and particularly preferably 45 to 55 mass % from the viewpoint of preserving stability. It is also preferable that the pH of the composition at 20° C. be made to be 6 to 8 and preferably 6.5 to 7.5 from the viewpoint of preserving stability and safety to the skin. As the pH regulator, acid agents including inorganic acids such as hydrochloric acid and sulfuric acid and organic acids such as citric acid, succinic acid, malic acid, fumaric acid, tartaric acid, malonic acid and maleic acid or alkali agents including sodium hydroxide, potassium hydroxide, ammonia and its derivative, amine salts such as monoethanolamine, diethanolamine and triethanolamine, sodium carbonate and potassium carbonate are preferably used either singly or in combinations. Particularly, an acid selected from hydrochloric acid, sulfuric acid and citric acid and an alkali agent selected from sodium hydroxide and potassium hydroxide are preferably used. Any of these compounds is formulated to the extent that it has no large influence on viscosity characteristics.

The viscosity of the composition of the present invention at 20° C. is preferably 10 to 1000 mPa·s, more preferably 30 to 700 mPa·s and particularly preferably 50 to 500 mPa·s from the viewpoint of working convenience. For example, the above components (g), (h), (i) and the like are used to adjust the viscosity.

The viscosity meant in the present invention is measured in the following manner. First, a B-type viscometer model BM manufactured by TOKIMEC. INC. is prepared which is equipped with a rotor having a Rotor Number No. 3. The sample is filled into a tall beaker and adjusted to 20° C. in a 20° C. thermostat. The sample adjusted to the fixed temperature is set to the viscometer. The number of rotations of the rotor is set to 30 r/m to measure the viscosity of the sample 60 seconds after the rotation is started as the viscosity used in the present invention.

As other components, any component which is formulated in usual liquid detergents may be formulated as far as it does not adversely affect viscosity characteristics.

Examples of these components include perfume components, sterilizing components, antiseptics, turbidity improvers and colorants.

The liquid detergent composition of the present invention is suitable as liquid detergent compositions for hard surface use (for kitchen use) such as washing of dishes and cookware and washing of kitchen surroundings.

The composition of the present invention may be used in washing methods using general liquid detergents for hand-washing. Specific examples of the washing method include a method using an aqueous solution diluted with water as a detergent solution and a method in which a sponge is impregnated directly with the aqueous solution. Particularly, the composition of the present invention is suitable to a method in which the composition is impregnated with a flexible material (preferably contains water) such as a sponge and the flexible material is brought into direct contact with (rubbing) dishes or cookware to carry out washing. In working of the washing method of this invention, a slimy feel on hard surfaces of, for example, dishes can be suppressed during washing and a slimy feel can be promptly washed away during rinsing. This effect is a peculiar effect obtained when the component (c) is contained and the same effect cannot be obtained even by using analogous compounds of the component (c).

The liquid detergent composition of the present invention has good foaming ability and detergency, is decreased in slimy feel on the hard surfaces of dishes and cookware during washing and has high ability of removing a slimy feel during rinsing.

EXAMPLES

The following examples further describe and demonstrate embodiments of the present invention. The examples are given solely for the purpose of illustration and are not to be construed as limitations of the present invention.

Liquid detergent compositions were prepared using components shown in Tables 1, 3 and 5. The foaming ability, feel to the touch and detergency of these compositions were evaluated by the following methods. The results are shown in Tables 1, 3 and 5.

Next, formulation examples in the case where the liquid detergent composition of the present invention is applied to detergents for kitchen use (for hard surfaces of dishes, cookware and the like) are shown in Tables 2, 4 and 6.

<Measurement of Foaming Ability>

A commercially available new sponge (flexible absorber, Kikuron) was washed with rubbing in city water and then wrung until the content of city water was 15 g. The sponge was impregnated with 30 g of an aqueous solution containing 1 mass % of each of the compositions shown in Tables 1, 3 and 5 and put on a china dish. The sponge on the dish was compressed twice with the hand by using a plastic plate equal in size to the sponge. Bubbles produced from the sponge were recovered in a measuring cylinder to measure the volume (ml) of the bubbles.

<Evaluation by a Feel>

1 g of a model oil soil prepared by blending 0.1 mass % of a dye (Sudan Red) in salad oil uniformly was applied and spread uniformly on a china dish to prepare a model soiled dish.

A commercially available new sponge (flexible absorber, Kikuron) was washed with rubbing in city water and then wrung until the content of city water was 15 g. The sponge was impregnated with 1 g of each of the compositions shown in Tables 1, 3 and 5 and 30 g of city water. The sponge was rubbed with the hands on the model soiled dish two or three times to make bubbles. Then, five model soiled dishes were washed with rubbing each by the sponge to functionally evaluate a slimy feel during washing according to the following standard.

Next, the model soiled dish which has been washed with rubbing was rinsed with city water to functionally evaluate the removability (relative evaluation of the time required until a slimy feel was eliminated) of a slimy feel during rinsing according to the following standard.

(Standard of a Slimy Feel During Washing)
Not much slimy: ○
Slimy a little: Δ
Very slimy: ×

(Standard of Removability of a Slimy Feel During Rinsing)
Slimy feel is removed immediately: ○
A little time is taken until a slimy feel is removed: Δ
A certain time is taken until a slimy feel is removed: ×

<Detergency Test>

1 g of a model oil soil prepared by blending 0.1 mass % of a dye (Sudan Red) in salad oil uniformly was applied and spread uniformly on a polypropylene dish to prepare a model soiled dish.

A commercially available new sponge (flexible absorber, Kikuron) was washed with rubbing in city water and then wrung until the content of city water was 15 g. The sponge was impregnated with 1 g of each of the compositions shown in Tables 1, 3 and 5 and 30 g of city water. The sponge was rubbed with the hands on the model soiled dish two or three times to make bubbles. Then, the model soiled dishes were washed with rubbing each by the sponge to find the number of dishes which could be washed (confirmed from a phenomenon that the color stuck to the dish disappeared).

TABLE 1

| | | | | Product of the present invention | Comparative product | | | | | |
|---|---|---|---|---|---|---|---|---|---|---|
| | | | | 1 | 1 | 2 | 3 | 4 | 5 | 6 |
| Liquid detergent composition | Composition (mass-%) | (a) | ES-I | 27.0 | 27.0 | 27.0 | 27.0 | 27.0 | 27.0 | 27.0 |
| | | (b) | AO-I | 5.0 | 5.0 | 5.0 | 5.0 | 5.0 | 5.0 | 5.0 |
| | | (c) | GE-2EH | 3.0 | — | — | — | — | — | — |
| | | | GE-C5 | — | — | 3.0 | — | — | — | — |
| | | | GE-isoC5 | — | — | — | 3.0 | — | — | — |
| | | | GE-C8 | — | — | — | — | 3.0 | — | — |
| | | | GE-C10 | — | — | — | — | — | 3.0 | — |
| | | | GE-isoC10 | — | — | — | — | — | — | 3.0 |
| | | (e) | Magnesium chloride · hexahydrate (note) | 3.5 (0.42) | 3.5 (0.42) | 3.5 (0.42) | 3.5 (0.42) | 3.5 (0.42) | 3.5 (0.42) | 3.5 (0.42) |

TABLE 1-continued

| | Product of the present invention | Comparative product | | | | | |
|---|---|---|---|---|---|---|---|
| | 1 | 1 | 2 | 3 | 4 | 5 | 6 |
| (f) Nonion-II | 3.0 | 3.0 | 3.0 | 3.0 | 3.0 | 3.0 | 3.0 |
| (g) p-TS | 2.5 | 2.5 | 2.5 | 2.5 | 2.5 | 2.5 | 2.5 |
| (h) Ethanol | 2.5 | 2.5 | 2.5 | 2.5 | 2.5 | 2.5 | 2.5 |
| PG | 5.0 | 5.0 | 5.0 | 5.0 | 5.0 | 5.0 | 5.0 |
| (d) Ion exchanged water | Balance | Balance | Balance | Balance | Balance | Balance | Balance |
| Total | 100 | 100 | 100 | 100 | 100 | 100 | 100 |
| pH(20° C.) | 6.6 | 6.6 | 6.6 | 6.6 | 6.6 | 6.6 | 6.6 |
| Foaming ability (ml) | 110 | 100 | 85 | 85 | 95 | 120 | 90 |
| Slimy feel during washing | ○ | Δ | Δ | Δ | Δ | X | X |
| Removability of a slimy feel during rinsing | ○ | X | X | X | Δ | X | X |
| Detergency (number of dishes) | 14 | 10 | 11 | 11 | 10 | 11 | 13 |

(note)
numericals in each parenthesis show a concentration (mass %) as magnesium in the composition.

TABLE 2

| | | | Formulation example | | | | | | | |
|---|---|---|---|---|---|---|---|---|---|---|
| | | | 1 | 2 | 3 | 4 | 5 | 6 | 7 | 8 |
| Liquid detergent composition | Composition (mass-%) | (a) ES-I | 29.0 | 29.0 | 26.0 | 29.0 | 29.0 | 26.0 | | |
| | | ES-II | | | | | | | 15.0 | |
| | | ES-III | | | | | | | | 17.0 |
| | | (b) AO-I | 5.0 | 5.0 | 8.0 | 5.0 | 3.5 | 8.0 | 5.0 | 7.5 |
| | | AO-II | | | | | 1.5 | | 0.3 | |
| | | (c) GE-2EH | 3.0 | 3.0 | 3.0 | 1.0 | 3.0 | 1.0 | 2.0 | 1.0 |
| | | (e) Magnesium chloride · hexahydrate (note) | 3.5 (0.42) | | | 3.5 (0.42) | 3.5 (0.42) | | | |
| | | (f) Nonion-I | 3.0 | 3.0 | 3.0 | 3.0 | 3.0 | 3.0 | 3.5 | 3.0 |
| | | Nonion-II | 3.0 | 3.0 | 3.0 | | 3.0 | 3.0 | 5.0 | 7.0 |
| | | Surfobetaine | | | | 3.0 | | 3.0 | 4.0 | 3.0 |
| | | (g) p-TS | 2.5 | 2.5 | 2.5 | 2.5 | 2.5 | 2.5 | 2.0 | 2.0 |
| | | (h) Ethanol | 4.0 | 4.0 | 5.0 | 4.0 | 4.0 | 5.0 | 6.5 | 5.0 |
| | | PG | 5.0 | 5.0 | 5.0 | 5.0 | 5.0 | | 3.0 | 2.0 |
| | | Anticeptic | 0.02 | 0.02 | 0.02 | 0.02 | 0.02 | 0.02 | 0.02 | 0.02 |
| | | Perfume | 0.35 | 0.35 | 0.35 | 0.35 | 0.35 | 0.35 | 0.30 | 0.35 |
| | | (d) Ion exchange water | Balance | Balance | Balance | Balance | Balance | Balance | Balance | Balance |
| | | Total | 100 | 100 | 100 | 100 | 100 | 100 | 100 | 100 |
| | | pH(20° C.) | 6.6 | 6.6 | 6.6 | 6.6 | 6.6 | 6.6 | 6.6 | 6.6 |

(note)
numericals in each parenthesis show a concentration (mass %) as magnesium in the composition.
(Note)
Each symbol in the tables represents the following material.
ES-1: Sodium polyoxyethylene alkyl ether sulfate (raw alcohol is an alcohol obtained by hydroformylation using 1-decene and 1-dodecene (50/50, mass ratio) as raw material. This alcohol was added with 2 mol of EO on the average, then sulfated by sulfur trioxide and neutralized by sodium hydroxide. The ratio of all sodium polyoxyethylene branched-chain alkyl ether sulfate to all sodium polyoxyethylene alkyl ether sulfate was 42 mass %.
ES-II: Ammonium polyoxyethylene coconut alkyl ether sulfate (EO average addition mol number: 2 mol)
ES-III: Ammonium polyoxyethylene lauryl ether sulfate (EO average addition mol number: 4 mol)
AO-I: N-lauryl-N,N-dimethylamine oxide
AO-II: N-lauric acid amidopropyl-N,N-dimethylamine oxide
GE-2EH: 2-Ethylhexyl monoglyceryl ether (monoglyceryl ether: 98 mass %, content of (c3): 2 mass %)
GE-C5: n-Pentylmonoglyceryl ether (monoglyceryl ether: 92 mass %, total of isomers and multimers: 8 mass %)
GE-isoC5: Isoamylmonoglyceryl ether (monoglyceryl ether: 95 mass %, total of isomers and multimers: 5 mass %)
GE-C8: n-Octylmonoglyceryl ether (monoglyceryl ether: 98 mass %, total of isomers and multimers: 2 mass %)
GE-C10: n-Decylmonoglyceryl ether (monoglyceryl ether: 96 mass %, total of isomers and multimers: 4 mass %)
GE-isoC10: iso-Decylmonoglyceryl ether (monoglyceryl ether: 94 mass %, total of isomers and multimers: 6 mass %)
Nonion-I: One obtained by adding EO in an amount of 7 mol on the average to a secondary alcohol with a mixture of alkyl groups having 12 and 13 carbon atoms (Softanol 70H, manufactured by Nippon Shokubai Co., Ltd.).
Nonion-II: Alkyl glucoside in which the composition of the alkyl groups is the following mixed alkyl group: alkyl group having 12 carbon atoms/alkyl group having 14 carbon atoms = 60/40 (mol ratio), and the glucoside average degree of condensation is 1.5
Sulfobetaine: N-lauryl-N,N-dimethyl-N-(2-hydroxy-1-sulfopropyl) ammoniumsulfobetaine
p-TS: Sodium p-toluenesulfonate
PG: Propylene glycol
Antiseptic: ProxelBDN (manufactured by Avecia K.K.)
pH: Adjusted using an aqueous 1N-sulfuric acid solution or 1N sodium hydroxide.

TABLE 3

| | Formulation ingredients (mass %) | Product of the present invention 21 | Comparative product 21 | 22 | 23 | 24 |
|---|---|---|---|---|---|---|
| Liquid detergent composition | (a)ES-1 | 27.0 | 27.0 | 27.0 | 27.0 | 27.0 |
| | (b)AO-1 | 5.0 | 5.0 | 5.0 | 5.0 | 5.0 |
| | (c-2)2EH-AO4 | 3.0 | — | — | — | — |
| | 2EH-AO6 | — | — | 3.0 | — | — |
| | C6-AO | — | — | — | 3.0 | — |
| | C8-AO | — | — | — | — | 3.0 |
| | (e)Magnesium chloride · hexahydrate (note) | 3.5 (0.42) | 3.5 (0.42) | 3.5 (0.42) | 3.5 (0.42) | 3.5 (0.42) |
| | (g)p-TS | 2.5 | 2.5 | 2.5 | 2.5 | 2.5 |
| | (h)Ethanol | 2.5 | 2.5 | 2.5 | 2.5 | 2.5 |
| | (h)PG | 5.0 | 5.0 | 5.0 | 5.0 | 5.0 |
| | water and pH regulator | Balance | Balance | Balance | Balance | Balance |
| | Total | 100 | 100 | 100 | 100 | 100 |
| | pH(20° C.) | 6.6 | 6.6 | 6.6 | 6.6 | 6.6 |
| Results of evaluation | Foaming ability(ml) | 120 | 100 | 100 | 90 | 110 |
| | Slimy feel during washing | ○ | Δ | Δ | Δ | Δ |
| | Removability of a slimy feel during rinsing | ○ | X | Δ | X | Δ |
| | Detergency (number of dishes) | 10 | 10 | 8 | 7 | 9 |

(note)
numericals in each parenthesis show a concentration (mass %) as magnesium in the composition.

As is clear from the comparison between the products of the present invention and the comparative product 21 in table 3, the inclusion of the component (c-2) ensures that the foaming ability and detergency of the products of the present invention are equal to or higher than those of the comparative product 21 and also ensures that the products of the present invention is decreased in a slimy feel during washing and succeeds in rapidly eliminating a slimy feel during rinsing.

Moreover, as is clear from the comparison between the products of the present invention and the comparative products 22 to 24 in table 3, the same effect as that of the present invention cannot be obtained even in the case of using a compound having a structure similar to that of the compound of the formula (5) which is the component (c-2).

TABLE 4

| | Formulation ingredients | | (mass-%) | Formulation example 21 | 22 | 23 | 24 | 25 | 26 | 27 | 28 |
|---|---|---|---|---|---|---|---|---|---|---|---|
| Liquid detergent composition | (a) | ES-I | | 27.0 | 29.0 | 27.0 | 27.0 | 27.0 | 23.0 | — | — |
| | | ES-II | | — | — | — | — | — | — | 15.0 | — |
| | | ES-III | | — | — | — | — | — | — | — | 17.0 |
| | (b) | AO-I | | 5.0 | 3.5 | 5.0 | 4.5 | 4.0 | 3.0 | 7.0 | 8.0 |
| | | AO-II | | — | 1.5 | — | — | — | 1.0 | 0.3 | 0.3 |
| | (c-2) | 2EH-AO4 | | 3.0 | 4.0 | 2.5 | — | — | 7.0 | 2.0 | 1.0 |
| | | 2EH-AO2 | | — | — | — | 3.0 | — | — | — | — |
| | | 2EH-AO5 | | — | — | — | — | 3.0 | — | — | — |
| | (e) | Magnesium chloride hexahydrate(note) | | 3.5 (0.42) | 3.5 (0.42) | 2.5 (0.30) | 3.5 (0.42) | 3.5 (0.42) | 2.0 (0.24) | — | — |
| | (f) | Nonion-I | | 3.0 | 6.0 | 5.0 | 5.0 | 5.0 | 3.0 | 3.5 | 3.5 |
| | | Sulfobetaine | | — | — | 1.0 | — | — | 0.5 | 3.5 | 4.0 |
| | (g) | p-TS | | 2.5 | 2.5 | 2.5 | 2.5 | 2.5 | 2.5 | 2.5 | 2.0 |
| | (h) | Ethanol | | 5.0 | 4.0 | 5.0 | 5.0 | 5.0 | 5.0 | 6.0 | 6.5 |
| | | PG | | 5.0 | 5.0 | 5.0 | 5.0 | 5.0 | 5.0 | — | — |
| | Others | Anticeptic | | 0.02 | 0.02 | 0.02 | 0.02 | 0.02 | 0.02 | 0.02 | 0.02 |
| | | Perfume | | 0.4 | 0.5 | 0.4 | 0.4 | 0.4 | 0.5 | 0.3 | 0.3 |
| | (d) | water and pH regulator | | Balance | Balance | Balance | Balance | Balance | Balance | Balance | Balance |
| | | Total | | 100 | 100 | 100 | 100 | 100 | 100 | 100 | 100 |
| | | pH(20° C.) | | 6.6 | 6.6 | 6.6 | 6.6 | 6.6 | 6.7 | 6.8 | 6.8 |

(note)
numericals in each parenthesis show a concentration (mass %) as magnesium in the composition.
(Note)
Each symbol in the table represents the following material.

TABLE 4-continued

| Formulation ingredients (mass-%) | Formulation example 21 | 22 | 23 | 24 | 25 | 26 | 27 | 28 |
|---|---|---|---|---|---|---|---|---|

2EH-AO2: A compound obtained by adding ethylene oxide in an amount of 2 mol on the average to 2-ethylhexyl alcohol (content of 2-ethylhexyl alcohol is 1 mass % or less)
2EH-AO4: A compound obtained by adding ethylene oxide in an amount of 4 mol on the average to 2-ethylhexyl alcohol (content of 2-ethylhexyl alcohol is 1 mass % or less)
2EH-AO5: A compound obtained by adding ethylene oxide in an amount of 5 mol on the average to 2-ethylhexyl alcohol (content of 2-ethylhexyl alcohol is 1 mass % or less)
2EH-AO6: A compound obtained by adding ethylene oxide in an amount of 6 mol on the average to 2-ethylhexyl alcohol (content of 2-ethylhexyl alcohol is 1 mass % or less)
C6-AO4: A compound obtained by adding ethylene oxide in an amount of 4 mol on the average to n-hexyl alcohol
C8-AO4: A compound obtained by adding ethylene oxide in an amount of 4 mol on the average to n-octyl alcohol
ES-I: Sodium polyoxyethylene alkyl ether sulfate (raw alcohol is an alcohol obtained by hydroformylation using 1-decene and 1-dodecene (50/50, mass ratio) as raw material. This alcohol was added with 2 mol of EO on the average, then sulfated by sulfur trioxide and neutralized by sodium hydroxide. The ratio of all sodium polyoxyethylene branched-chain alkyl ether sulfate to all sodium polyoxyethylene alkyl ether sulfate was 42 mass %.
ES-II: Ammonium polyoxyethylene coconut alkyl ether sulfate (EO average addition mol number: 2 mol)
ES-III: Ammonium polyoxyethylene lauryl ether sulfate (EO average addition mol number: 4 mol)
AO-I: N-lauryl-N,N-dimethylamine oxide
AO-II: N-lauric acid amidopropyl-N,N-dimethylamine oxide
Nonion-I: One obtained by adding EO in an amount of 7 mol on the average to a secondary alcohol with a mixture of alkyl groups having 12 and 13 carbon atoms (Softanol 70H, manufactured by Nippon Shokubai Co., Ltd.)
Sulfobetaine: N-lauryl-N,N-dimethyl-N-(2-hydroxy-1-sulfopropyl)ammoniumsulfobetaine
p-TS: Sodium p-toluenesulfonate
PG: Propylene glycol
Antiseptic: ProxelBDN (manufactured by Avecia K.K.)
pH: Adjusted using a pH regulator of an aqueous 1N-sulfuric acid solution or 1N sodium hydroxide.

TABLE 5

| | Formulation ingredients (mass %) | Product of the present invention 31 | Comparative product 21 | 32 | 33 | 34 |
|---|---|---|---|---|---|---|
| Liquid detergency composition | (a)ES-1 | 27.0 | 27.0 | 27.0 | 27.0 | 27.0 |
| | (b)AO-1 | 5.0 | 5.0 | 5.0 | 5.0 | 5.0 |
| | (c-3)AG-2EH | 3.0 | — | — | — | — |
| | AG-C6 | — | — | 3.0 | — | — |
| | AG-C8 | — | — | — | 3.0 | — |
| | AG-C10 | — | — | — | — | 3.0 |
| | (e)Magnesium chloride · hexahydrate(note) | 3.5 (0.42) | 3.5 (0.42) | 3.5 (0.42) | 3.5 (0.42) | 3.5 (0.42) |
| | (g)p-TS | 2.5 | 2.5 | 2.5 | 2.5 | 2.5 |
| | (h)Ethanol | 2.5 | 2.5 | 2.5 | 2.5 | 2.5 |
| | (h)PG | 5.0 | 5.0 | 5.0 | 5.0 | 5.0 |
| | (d)Ion exchange water and pH regulator | Balance | Balance | Balance | Balance | Balance |
| | Total | 100 | 100 | 100 | 100 | 100 |
| | pH(20° C.) | 6.6 | 6.6 | 6.6 | 6.6 | 6.6 |
| Results of evaluation | Foaming ability (ml) | 110 | 100 | 90 | 110 | 105 |
| | Slimy feel during washing | ○ | Δ | Δ | Δ | Δ |
| | Removability of a slimy feel during rinsing | ○ | X | X | Δ | Δ |
| | Detergency (number of dishes) | 12 | 10 | 8 | 12 | 10 |

(note)
Numerals in each parenthesis show a concentration (mass %) as magnesium in the composition.

As is clear from the comparison between the products of the present invention and the comparative product 21 in table 5, the inclusion of the component (c-3) ensures that the foaming ability and detergency of the products of the present invention are higher than those of the comparative product 21 and also ensures that the products of the present invention is decreased in a slimy feel during washing and succeeds in rapidly eliminating a slimy feel during rinsing.

Moreover, as is clear from the comparison between the products of the present invention and the comparative products 32 to 34 in table 5, the same effect as that of the present invention cannot be obtained even in the case of using a compound having a structure similar to that of the compound of the formula (6) which compound is the component (c-3).

Next, formulation examples when the liquid detergent composition of the present invention is applied to detergents for kitchen use (for hard surfaces of dishes, cookware and the like) are shown in Table 6.

TABLE 6

| Formulation ingredients | | | Formulation example | | | | | | | |
|---|---|---|---|---|---|---|---|---|---|---|
| | | (mass %) | 31 | 32 | 33 | 34 | 35 | 36 | 37 | 38 |
| Liquid detergency composition | (a) | ES-I | 27.0 | 29.0 | 27.0 | 27.0 | 27.0 | 23.0 | — | — |
| | | ES-II | — | — | — | — | — | — | 15.0 | — |
| | | ES-III | — | — | — | — | — | — | — | 17.0 |
| | (b) | AO-I | 5.0 | 3.5 | 5.0 | 4.5 | 4.0 | 3.0 | 7.0 | 8.0 |
| | | AO-II | — | 1.5 | — | — | — | 1.0 | 0.3 | 0.3 |
| | (c-3) | AG-2EH | 3.0 | 4.0 | 2.5 | — | — | 7.0 | 2.0 | 1.0 |
| | | AG-iN | — | — | — | 3.0 | — | — | — | — |
| | | AG-iD | — | — | — | — | 3.0 | — | — | — |
| | (e) | Magnesium chloride · hexahydrate(note) | 3.5 (0.42) | 3.5 (0.42) | 2.5 (0.30) | 3.5 (0.42) | 3.5 (0.42) | 2.0 (0.24) | — | — |
| | (f) | Nonion-I | 3.0 | 6.0 | 5.0 | 5.0 | 5.0 | 3.0 | 3.5 | 3.5 |
| | | Sulfobetaine | — | — | 1 | — | — | 0.5 | 3.5 | 4.0 |
| | (g) | p-TS | 2.5 | 2.5 | 2.5 | 2.5 | 2.5 | 2.5 | 2.5 | 2.0 |
| | (h) | Ethanol | 5.0 | 4.0 | 5.0 | 5.0 | 5.0 | 5.0 | 6.0 | 6.5 |
| | | PG | 5.0 | 5.0 | 5.0 | 5.0 | 5.0 | 5.0 | — | — |
| | Others | Antiseptic | 0.02 | 0.02 | 0.02 | 0.02 | 0.02 | 0.02 | 0.02 | 0.02 |
| | | Perfume | 0.4 | 0.5 | 0.4 | 0.4 | 0.4 | 0.5 | 0.3 | 0.3 |
| | (d) | Ion exchange water and pH | Balance | Balance | Balance | Balance | Balance | Balance | Balance | Balance |
| | | Total | 100 | 100 | 100 | 100 | 100 | 100 | 100 | 100 |
| | | pH(20° C.) | 6.6 | 6.6 | 6.6 | 6.6 | 6.6 | 6.7 | 6.8 | 6.8 |

(note)
Numerals in each parenthesis show a concentration (mass %) as magnesium in the composition.
(Note)
Each symbol in the table represents the following material.
AG-2EH: 2-Ethylhexylglycoside (glucose average degree of condensation: 1.3 mol)
AG-iN: Isononylglycoside (glucose average degree of condensation: 1.5 mol)
AG-iD: Isodecylglycoside (glucose average degree of condensation: 1.7 mol)
AG-C6: n-Hexylglycoside (glucose average degree of condensation: 1.3 mol)
AG-C8: n-Octylglycoside (glucose average degree of condensation: 1.3 mol)
AG-C10: n-Decylglycoside (glucose average degree of condensation: 1.7 mol)
ES-I: Sodium polyoxyethylene alkyl ether sulfate (raw alcohol is an alcohol obtained by hydroformylation using 1-decene and 1-dodecene (50/50, mass ratio) as a raw material. This alcohol was added with 2 mol of EO on the average, then sulfated by sulfur trioxide and neutralized by sodium hydroxide. The ratio of all sodium polyoxyethylene branched-chain alkyl ether sulfate to all sodium polyoxyethylene alkyl ether sulfate was 42 mass %.
ES-II: Ammonium polyoxyethylene coconut alkyl ether sulfate (EO average addition mol number: 2 mol)
ES-III: Ammonium polyoxyethylene lauryl ether sulfate (EO average addition mol number: 4 mol)
AO-I: N-lauryl-N,N-dimethylamine oxide
AO-II: N-lauric acid amidopropyl-N,N-dimethylamine oxide
Nonion-I: One obtained by adding EO in an amount of 7 mol on the average to a secondary alcohol with a mixture of alkyl groups having 12 and 13 carbon atoms (Softanol 70H, manufactured by Nippon Shokubai Co., Ltd.)
Sulfobetaine: N-lauryl-N,N-dimethyl-N-(2-hydroxy-1-sulfopropyl) ammoniumsulfobetaine
p-TS: Sodium p-toluenesulfonate
PG: Propylene glycol
Antiseptic: ProxelBDN (manufactured by Avecia K.K.)
pH: Adjusted using a pH regulator of an aqueous 1N-sulfuric acid solution or 1N sodium hydroxide.

The invention claimed is:

1. A liquid detergent composition comprising (a) 5 to 50 mass % of an anionic surfactant containing a hydrocarbon group having 10 to 18 carbon atoms, (b) 1 to 15 mass % of an amine oxide surfactant containing a hydrocarbon group having 10 to 18 carbon atoms, 0.1 to 10 mass % of (c-1) 2-ethylhexyl monoglyceryl ether, (d) water and (e) magnesium in an amount of 0.01 to 2 percent by mass.

2. The liquid detergent composition according to claim 1, wherein the ratio by mass of (a)/(b) is 20/1 to 1/1.

* * * * *